US011749971B1

(12) United States Patent
Sanda et al.

(10) Patent No.: US 11,749,971 B1
(45) Date of Patent: Sep. 5, 2023

(54) METALLIC SHELL FOR SPARK PLUG AND SPARK PLUG USING THE SAME

(71) Applicant: NGK SPARK PLUG CO., LTD., Nagoya (JP)

(72) Inventors: Takahiro Sanda, Nagoya (JP); Keita Sugihara, Nagoya (JP); Noriyasu Hasegawa, Nagoya (JP); Yohei Kozakai, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 18/109,934

(22) Filed: Feb. 15, 2023

(30) Foreign Application Priority Data

Feb. 18, 2022 (JP) ..... 2022-023445

(51) Int. Cl.
*H01T 13/06* (2006.01)

(52) U.S. Cl.
CPC ..... *H01T 13/06* (2013.01)

(58) Field of Classification Search
CPC ..... H01T 13/06
See application file for complete search history.

(56) References Cited

U.S. PATENT DOCUMENTS

2011/0037372 A1* 2/2011 L'Henoret ..... H01T 13/40 445/7
2012/0146483 A1* 6/2012 Kadowaki ..... H01T 13/39 445/7

FOREIGN PATENT DOCUMENTS

JP 2000-048930 A 2/2000

* cited by examiner

*Primary Examiner* — Anne M Hines
(74) *Attorney, Agent, or Firm* — KUSNER & JAFFE

(57) ABSTRACT

A metallic shell for a spark plug which metallic shell achieves suppressed elution of hexavalent chromium, and a spark plug including the metallic shell. The spark plug has a metallic shell. The metallic shell includes a tubular metallic shell body; a metal plating layer provided on a surface of the metallic shell body; and a chromium-containing chemical conversion coating layer provided to cover the metal plating layer. The chemical conversion coating layer has a zirconium component content of 0.1 mass % or more.

8 Claims, 5 Drawing Sheets

METALLIC SHELL FOR SPARK PLUG AND SPARK PLUG USING THE SAME

FIELD OF INVENTION

The present invention relates to a metallic shell for a spark plug used in an internal combustion engine, and to a spark plug including this metallic shell.

BACKGROUND ART

Spark plugs have been used as igniting means of internal combustion engines such as engines for automobiles. Such a spark plug includes a rod-shaped center electrode, an insulator which holds the center electrode on its a forward end side and extends in an axial direction, and a tubular metallic shell which holds the insulator therein. The spark plug is configured such that spark discharge occurs between a forward end portion of the center electrode and a ground electrode attached to a forward end portion of the metallic shell.

In general, the metallic shell is formed of an iron-based material such as carbon steel, and its surface is plated for corrosion prevention. Such plating is performed, for example, in an alkaline plating bath containing zinc. As a result, a zinc plating layer is formed on the surface of the metallic shell. The zinc plating layer has an excellent corrosion prevention effect for iron. However, the zinc plating layer formed on the surface of a metallic shell formed of iron has drawbacks in that the zinc plating layer is easily consumed due to sacrificial corrosion, and tends to whiten due to produced zinc oxide, thereby impairing the appearance of the metallic shell.

In view of the above, in many spark plugs, the surface of the zinc plating layer is further covered with chromate conversion coating so as to prevent corrosion of the plating layer. For example, Japan Patent Application Publication No. JP2000-48930A ("Patent Literature 1") discloses a spark plug in which the surface of its metallic shell is covered with silicon-containing chromate conversion coating whose cationic components mainly include chromium and silicon and in which 90 wt. % or more of chromium is trivalent chromium.

In a spark plug covered with such a chromate conversion coating, corrosion of the zinc plating layer is successfully suppressed. However, such a spark plug has raised a problem in that a certain component contained in the chromate conversion coating is eluted into the environment in the form of hexavalent chromium.

SUMMARY OF INVENTION

An object of the present invention is to provide a metallic shell for a spark plug which metallic shell achieves suppressed elution of hexavalent chromium. Another object of the invention is to provide a spark plug including the metallic shell.

In a first aspect of the present invention, there is provided a metallic shell for a spark plug, the metallic shell having a tubular metallic shell body; a metal plating layer provided on a surface of the metallic shell body; and a chromium-containing chemical conversion coating layer provided to cover the metal plating layer. In the metallic shell for a spark plug, the chemical conversion coating layer has a zirconium component content of 0.1 mass % or more.

According to the aforementioned configuration, corrosion of the metal plating layer can be suppressed by virtue of the chemical conversion coating layer provided so as to cover the metal plating layer. In addition, since the zirconium component content of the chemical conversion coating layer is 0.1 mass % or more, there can be provided a metallic shell for a spark plug achieving suppressed elution of hexavalent chromium.

In the metallic shell for a spark plug according to the first aspect of the present invention, the zirconium component content of the chemical conversion coating layer may be 2.0 mass % or less.

According to the aforementioned configuration, a relative decrease in another component content of the chemical conversion coating layer can be avoided by adjusting the zirconium component content of the chemical conversion coating layer to 2.0 mass % or less.

In the metallic shell for a spark plug according to the first aspect of the present invention, the chemical conversion coating layer may further contain a cobalt component, and the cobalt component content may be equal to or lower than the aforementioned zirconium component content.

According to the aforementioned configuration, corrosion of the surface of the metallic shell can be suppressed by virtue of the cobalt component present in the chemical conversion coating layer. Also, since the cobalt component content of the chemical conversion coating layer is equal to or lower than the zirconium component content, elution of hexavalent chromium can be suppressed to a low level, even when the chemical conversion coating layer contains a cobalt component.

In the metallic shell for a spark plug according to the first aspect of the present invention, the chemical conversion coating layer may further contain a cobalt component, and the cobalt component content of may be 0.1 mass % or less.

According to the aforementioned configuration, corrosion of the surface of the metallic shell can be suppressed by virtue of the cobalt component present in the chemical conversion coating layer. Also, since the cobalt component content of the chemical conversion coating layer is adjusted to 0.1 mass % or less, elution of hexavalent chromium can be suppressed to a low level, even when the chemical conversion coating layer contains a cobalt component.

In a second aspect of the present invention, there is provided a spark plug having a metallic shell for a spark plug according to the first aspect of the present invention, a tubular insulator at least partially disposed in the metallic shell; a center electrode disposed at a forward end of the insulator; and a ground electrode joined to the metallic shell and forming a gap between the ground electrode and the center electrode.

By virtue of the aforementioned configuration, it is possible to obtain a spark plug including a metallic shell from which elution of hexavalent chromium can be suppressed. Thus, there can be obtained a spark plug which achieves reduced adverse impact on the environment (i.e., elution of hexavalent chromium).

As described herein above, according to the first aspect of the present invention, there can be obtained a spark plug metallic shell in which elution of hexavalent chromium can be suppressed. Also, according to the second aspect of the present invention, there can be obtained a spark plug in which elution of hexavalent chromium can be suppressed.

DETAILED DESCRIPTION OF INVENTION

An embodiment of the present invention will now be described with reference to the drawings. The present embodiment will be described, taking a spark plug 1 as an example. Also, in the present embodiment, a method for manufacturing a metallic shell 30 which constitutes the spark plug 1 will be described.

(Structure of Spark Plug)

Figure 1:
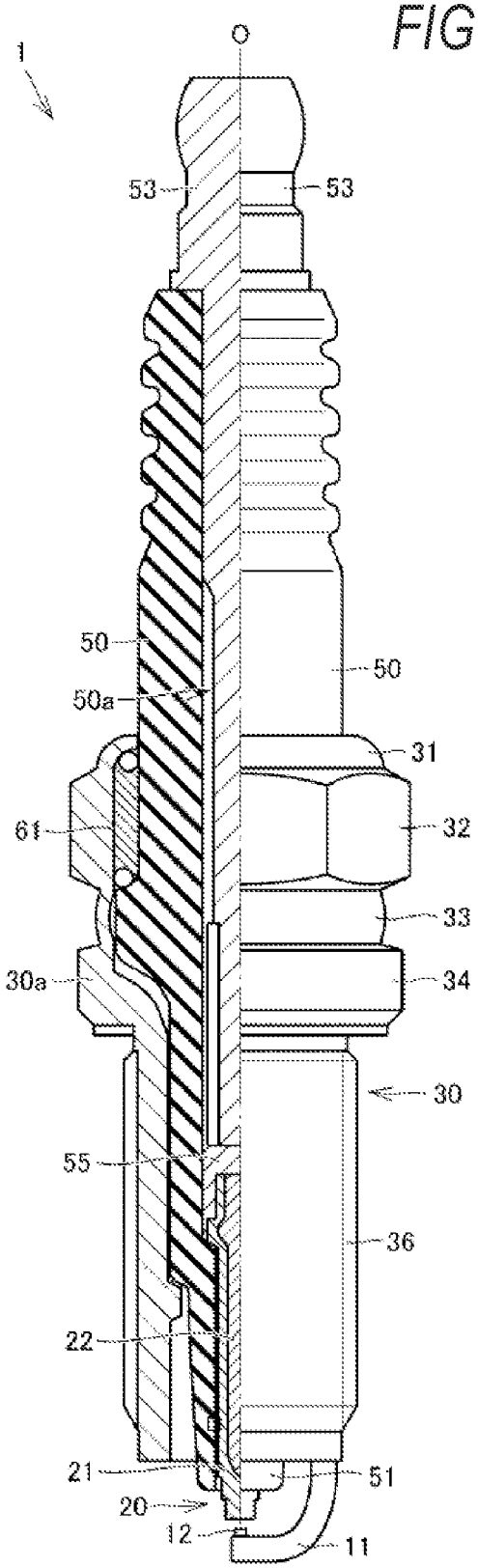
FIG. 1 is a partial sectional view showing the appearance and internal structure of a spark plug according to one embodiment of the present invention.

First, the overall structure of the spark plug 1 will be described with reference to FIG. 1. The spark plug 1 includes an insulator 50 and the metallic shell 30.

The insulator 50 is an approximately cylindrical tubular member extending in a longitudinal direction of the spark plug 1. An axial hole 50*a* extending along an axial line O is formed in the insulator 50. The insulator 50 is formed of a material which is excellent in insulating property, heat resistance, and heat conductivity. For example, the insulator 50 is formed of an alumina-based ceramic material or the like.

A center electrode 20 is provided in a forward end portion 51 of the insulator 50. In the present embodiment, a side in the spark plug 1 where the center electrode 20 is provided will be referred to as the forward end side of the spark plug 1, and a side opposite the forward end side will be referred to as the rear end side. In FIG. 1, the lower side is the forward end side, and the upper side is the rear end side.

A metallic terminal member 53 is attached to the other end (namely, a rear end portion) of the insulator 50. An electrically conductive glass seal 55 is provided between the center electrode 20 and the metallic terminal member 53.

The center electrode 20 is inserted into and held in the axial hole 50*a* of the insulator 50 in such a manner that a forward end portion of the center electrode 20 protrudes from the forward end portion 51 of the insulator 50. The center electrode 20 has an electrode base member 21 and a core 22. The electrode base member 21 is formed of, for example, a metallic material such as an Ni-base alloy containing Ni (nickel) as a main component. An example of an alloy element added to the Ni-base alloy is Al (aluminum). The core 22 is embedded in the electrode base member 21. The core 22 may be formed of a metallic material (for example, Cu (copper) or Cu alloy or the like) which is more excellent in thermal conductivity than the electrode base member 21. The electrode base member 21 and the core 22 are united together by means of forging. Notably, this configuration is one example, and the core 22 may be omitted. Namely, the center electrode 20 may be formed of the electrode base member only.

The forward end of the center electrode 20 is provided with, for example, a noble metal tip formed into a cylindrical shape. The noble metal tip is joined to the forward end of the center electrode 20 through, for example, welding. The noble metal tip contains, for example, one noble metal selected from among Pt, Rh, Ir, and Ru in an amount of 50 wt. % or more.

The metallic shell (metallic shell for a spark plug) 30 is an approximately cylindrical tubular member which is fixed to a threaded hole of an internal combustion engine. The metallic shell 30 is provided to partially cover the insulator 50. In a state in which a portion of the insulator 50 has been inserted into the metallic shell 30 having an approximately cylindrical tubular shape, a gap present between the metallic shell 30 and the insulator 50 on the rear end side of the metallic shell 30 is filled with talc 61.

The main body portion of the metallic shell 30 is formed of a tubular metallic shell body 30*a*. The metallic shell body 30*a* is formed of a metallic material having electrical conductivity. Examples of such a metallic material include low carbon steel and a metallic material which contains iron as a main component. The metallic shell body 30*a* has mainly a crimp portion 31, a tool engagement portion 32, a curved portion 33, a bearing portion 34, a trunk portion 36, etc., which are disposed in this order from the rear end side.

The tool engagement portion 32 is a portion with which a tool such as a wrench is engaged when the metallic shell 30 is attached to the threaded hole of the internal combustion engine. The crimp portion 31 is formed on the rear end side of the tool engagement portion 32. The crimp portion 31 is bent radially inward such that the degree of bending increases toward the rear end side. The bearing portion 34 is located between the tool engagement portion 32 and the trunk portion 36, and an annular gasket is disposed on the forward end side. In a state in which the spark plug 1 is attached to the internal combustion engine, the bearing portion 34 presses the annular gasket against an unillustrated engine head. The curved portion 33 having a small wall thickness is formed between the tool engagement portion 32 and the bearing portion 34. The trunk portion 36 is located on the side where the forward end portion 51 of the insulator 50 is present. When the spark plug 1 is attached to the internal combustion engine, a screw groove (not show) formed on the outer circumference of the trunk portion 36 is screwed into the threaded hole of the internal combustion engine.

Also, a ground electrode 11 is provided on the forward end portion side of the metallic shell 30 (on the side where the trunk portion 36 is located). The ground electrode 11 is joined to the metallic shell 30 by means of, for example, welding. The ground electrode 11 is a plate-like member bent to have an approximately L-like shape as a whole, and a proximal end portion of the ground electrode 11 is fixedly joined to a forward end surface of the metallic shell 30. A distal end portion of the ground electrode 11 extends to a position through which an imaginary extension line of the axial line O of the insulator 50 passes. A noble metal tip 12 which faces a forward end surface of the center electrode 20 is welded to a surface of the ground electrode 11, which surface is located on the side toward the center electrode 20, such that the noble metal tip is located near the distal end of the ground electrode 11.

As a result, the distal end of the ground electrode 11 is disposed to face the forward end portion of the center electrode 20, and a gap in which spark discharge occurs is formed between the distal end of the ground electrode 11 (specifically, the noble metal tip 12 welded to the ground electrode 11) and the forward end portion of the center electrode 20. Notably, in an alternative embodiment, no noble metal tip 12 is joined to the ground electrode 11.

The ground electrode 11 is formed, for example, by using, as an electrode base material, a metallic material such as an Ni-base alloy containing Ni (nickel) as a main component. An example of an alloy element added to the Ni-base alloy is Al (aluminum). The ground electrode 11 may contain, as a component other than Ni, at least one element selected from Mn (manganese), Cr (chromium), Al (aluminum), and Ti (titanium).

(Structure of Metallic Shell)

Figure 2:
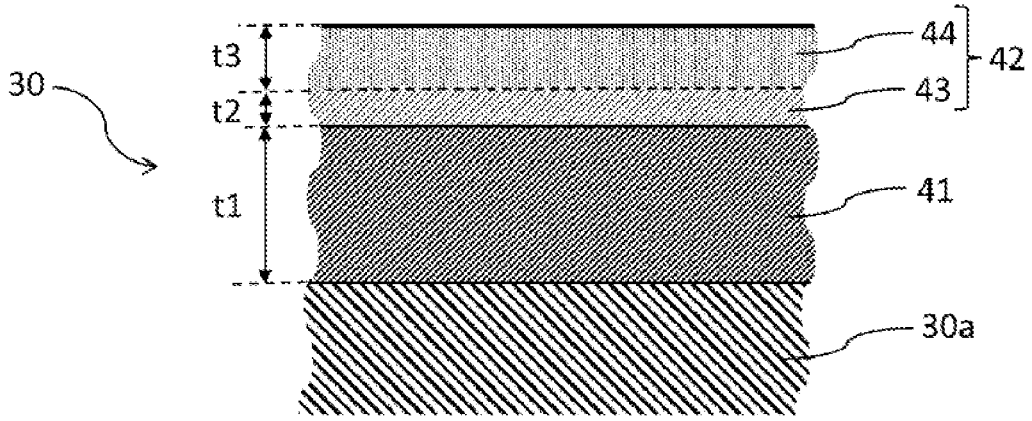
FIG. 2 is a schematic sectional view showing the configuration of a part of a surface portion of a metallic shell of the spark plug shown in FIG. 1.

Subsequently, the structure of the metallic shell 30, which constitutes the spark plug 1, will be described more specifically. Here, a coating formed on the surface of the metallic shell 30 will be described. FIG. 2 shows a sectional structure of a part of a surface portion of the metallic shell 30.

The coating on the surface of the metallic shell 30 is composed of a plurality of layers containing different types of components. This coating has at least two layers; i.e., a zinc plating layer (metal plating layer) 41 and a chemical conversion coating layer 42. Specifically, the coating on the surface of the metallic shell 30 has a structure in which the zinc plating layer 41 and the chemical conversion coating layer 42 are stacked in this order from the side near the metallic shell body 30*a* (see FIG. 2).

The zinc plating layer 41 is provided on the surface of the metallic shell body 30*a*. The chemical conversion coating layer 42 is provided so as to cover the zinc plating layer 41. The chemical conversion coating layer 42 contains chromium (Cr) and other elements.

The zinc plating layer 41 contains zinc (Zn) as a main component. The expression "contains Zn as a main component" means that, among the elements contained in the zinc plating layer 41, Zn is contained in the largest amount. The zinc plating layer 41 can be formed by performing a conventionally known galvanizing process on the surface of the metallic shell body 30*a*. The thickness t1 of the zinc plating layer 41 may be set to fall within the range of, for example, 3 μm to 10 μm.

Notably, in the present embodiment, the metal plating layer is described, taking the zinc plating layer 41 as an example. However, the metal plating layer provided on the metallic shell 30 is not limited to the zinc plating layer and may be, for example, a nickel plating layer.

The chemical conversion coating layer 42 has a plurality of layers including a chromium layer 43 which contains chromium (Cr) as a main component and a silicon layer 44 which contains silicon (Si) as a main component (see FIG. 2).

The chromium layer 43 contains chromium (Cr) as a main component. The expression "contains Cr as a main component" means that, among the elements contained in the chromium layer 43, Cr is contained in the largest amount. The Cr component of the chromium layer 43 is mostly (for example, 90 mass % or more of the entire Cr component) present as a trivalent chromium chromate.

The chromium layer 43 contains, an additional component other than chromium, zirconium (Zr). Zirconium (Zr) is present in the chromium layer 43 as an ionic compound mainly composed of zirconium, chromium, oxygen, and hydrogen. In this embodiment, zirconium present in the chemical conversion coating layer 42 (more specifically, mainly in the chromium layer 43) as an element forming the above ionic compound corresponds to the zirconium component.

Also, the chromium layer 43 may contain an additional component such as cobalt (Co), zinc (Zn), or iron (Fe). The cobalt component contained in the chemical conversion coating layer 42 successfully suppresses corrosion of the surface of the metallic shell.

When the chromium layer 43 contains a cobalt component, the cobalt component content of the chemical conversion coating layer 42 is preferably equal to or lower than the zirconium component content. Also, when the chromium layer 43 contains a cobalt component, the cobalt component content of the chemical conversion coating layer 42 is preferably 0.1 mass % or less.

Chromium contained in the trivalent chromium chromate is present in the form of $Cr^{3+}$ at the time of coating formation. When the coating contains a cobalt component, $Cr^{3+}$ is oxidized by the cobalt component and is converted to $Cr^{6+}$ (hexavalent chromium) with time. Therefore, setting the cobalt component content of the chromium layer 43 to 0.1 mass % or less allows the Cr component in the coating to exist stably in the form of $Cr^{3+}$, whereby the amount of elution of hexavalent chromium from the coating can be reduced. Notably, it is preferred that the chemical conversion coating layer 42 contain no cobalt, from the viewpoint of further reducing the amount of elution of hexavalent chromium from the coating.

The zirconium component content of the chemical conversion coating layer 42 is 0.1 mass % or more. During the below-mentioned chemical conversion coating layer formation step, zirconium is incorporated into the chemical conversion coating layer 42 in the form of $Zr^{3+}$. Thereafter, as shown in the following chemical equation (I), the zirconium component in the chemical conversion coating layer 42 will be transformed to $Zr^{4+}$, which is the most stable form. As a result, the inside of the chemical conversion coating layer 42 is provided with a reducing atmosphere.

$$3Zr^{3+}3Zr^{4+}+3e^{-} \quad \text{(I)}$$

Thus, by virtue of the zirconium component contained in the chromium layer 43, the chromium component in the chemical conversion coating layer 42 will be converted from hexavalent chromium ($Cr^{6+}$) to $Cr^{3+}$, which is a more stable form (as shown in the following chemical equation (II)). In other words, the presence of the zirconium component in the chromium layer 43 allows the Cr component in the chemical conversion coating layer 42 to exist stably in the form of $Cr^{3+}$.

$$Cr^{6+}+3e^{-}\rightarrow Cr^{3+} \quad \text{(II)}$$

As described above, the amount of elution of hexavalent chromium from the coating can be reduced by the presence of the zirconium component in the chemical conversion coating layer 42.

Further, even when the chemical conversion coating layer 42 contains a cobalt component, the amount of elution of hexavalent chromium can be reduced by the presence of the zirconium component in the chemical conversion coating layer 42. The cobalt component content of the chemical conversion coating layer 42 is preferably equal to or lower than the zirconium component content. In this case, the amount of elution of hexavalent chromium can be further reduced.

The zirconium component content of the chemical conversion coating layer 42 is preferably 2.0 mass % or less. This is because, even when the zirconium component content is augmented be more than 2.0 mass %, the effect of reducing the amount of elution of hexavalent chromium commensurate with the increase cannot be attained. Also, through controlling the zirconium component content to 2.0 mass % or less, a relative decrease in another component content of the chemical conversion coating layer 42 can be avoided.

The silicon layer 44 contains silicon oxide ($SiO_2$) as a main component. The expression "contains silicon oxide ($SiO_2$) as a main component" means that, among the elements contained in the silicon layer 44, silicon oxide ($SiO_2$) is contained in the largest amount.

The coating on the surface of the metallic shell 30 may further have an additional intermediate layer in addition to the zinc plating layer 41, the chromium layer 43, and the chemical conversion coating layer 42 having the silicon layer 44. Specifically, an intermediate layer mainly containing zinc (Zn) and chromium (Cr) may be provided between the zinc plating layer 41 and the chromium layer 43. Alternatively, an intermediate layer mainly containing chromium (Cr) and silicon (Si) may be provided between the chromium layer 43 and the silicon layer 44.

The chemical conversion coating layer 42 can be formed by performing a coating process (chemical conversion coating layer forming step) which will be described later with respect to the metallic shell body 30*a* with the zinc plating layer 41 formed thereon.

The thickness t2 of the chromium layer 43 included in the chemical conversion coating layer 42 may be set to fall within the range of, for example, 0.05 μm to 0.30 μm. Setting the thickness t2 of the chromium layer 43 to 0.05 μm or greater facilitates formation of the silicon layer 44, which is the uppermost layer. As a result, the corrosion prevention effect of the zinc plating layer 41 which has been covered with the silicon layer 44 and the chromium layer 43 can be enhanced. Also, setting the thickness t2 of the chromium layer 43 to 0.30 μm or less can reduce the amount of chromium to be used.

Also, the thickness of the chromium layer 43 is preferably less than 0.20 μm. By reducing the thickness of the chromium layer 43 to be less than 0.20 μm, the absolute amount of chromium contained in the coating on the surface of the metallic shell can be reduced. As a result, elution of hexavalent chromium from the metallic shell can be further suppressed.

The thickness t3 of the silicon layer 44 included in the chemical conversion coating layer 42 may be set to fall within the range of, for example, 0.05 μm to 1.0 μm. Setting the thickness t3 of the silicon layer 44 to 0.05 μm or greater enhances the effect of corrosion prevention of the zinc plating layer 41. Also, setting the thickness t3 of the silicon layer 44 to 1.0 μm or less prevents an increase in the degree of insulation of the surface of the metallic shell 30, thereby maintaining the electricity conducting performance of the spark plug 1.

The ratio t3/t2 of the thickness t3 of the silicon layer 44 to the thickness t2 of the chromium layer 43 is 0.8 or greater. Since the ratio between the thicknesses of these layers is set in this manner, even when the cobalt content of the chromium layer 43 is reduced, corrosion of the surface of the metallic shell can be suppressed.

Notably, the ratio t3/t2 of the thickness t3 of the silicon layer 44 to the thickness t2 of the chromium layer 43 is more preferably 1.9 or greater. By setting the ratio between the thicknesses of these layers in this manner, the effect of preventing corrosion of the surface of the metallic shell can be further enhanced.

Since the silicon layer 44 is formed so as to cover the chromium layer 43, the anticorrosion performance of the coating provided on the surface of the metallic shell 30 can be enhanced. As a result, corrosion of the metallic shell body 30*a* can be more effectively secured.

In addition, since the thickness t3 of the silicon layer 44 is regulated to fall within the above range, a coating exhibiting sufficient anti-corrosion performance can be obtained, even when the cobalt component content of the chromium layer 43 is reduced. Also, the effect of protecting the zinc plating layer 41 is enhanced, whereby sacrificial corrosion of the zinc plating layer 41 can be suppressed.

(Metallic Shell Manufacturing Method)

Next will be described a method for manufacturing the metallic shell 30. First, the metallic shell body 30*a* is manufactured. Since a conventionally known manufacturing method can be applied to manufacture of the metallic shell body 30*a*, detailed description of a method for manufacturing the metallic shell body 30*a* is omitted.

Figure 3:
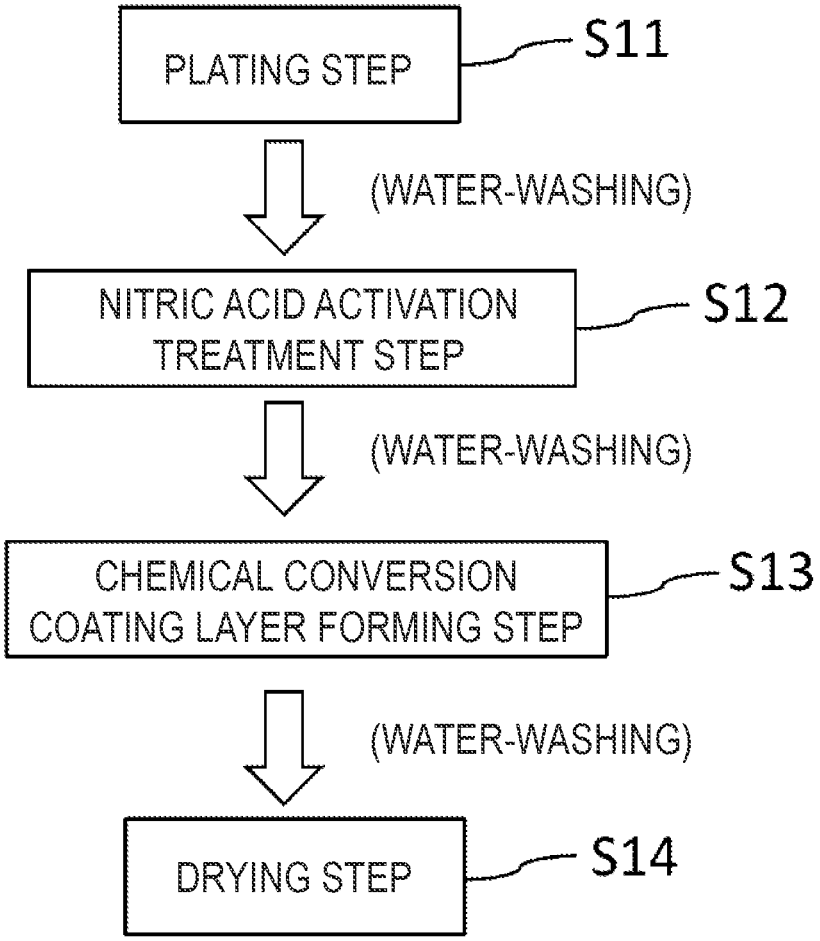
FIG. 3 is a flowchart showing a portion of a process of manufacturing the spark plug shown in FIG. 1. Specifically, a flowchart showing steps of forming a coating on the metallic shell.

Subsequently, coating layers (specifically, the zinc plating layer 41, the chemical conversion coating layer 42, etc.) are formed on the surface of the metallic shell body 30*a*. FIG. 3 shows steps of forming the coating layers on the surface of the metallic shell body 30*a*. As shown in FIG. 3, the steps of forming the coating layers mainly include a plating step (S11), a nitric acid activation treatment step (S12), a chemical conversion coating layer forming step (S13), and a drying step (S14). Also, a water-washing step of washing the metallic shell body 30*a* is performed between the above-described steps.

In the plating step (S11), the zinc plating layer 41 is formed on the surface of the metallic shell body 30*a* by using, for example, a conventionally known electro-galvanizing method. Subsequently, the nitric acid activation treatment step (S12) is performed. In this step, the metallic shell body 30*a* is immersed into an acidic solution containing nitric acid, thereby removing deposited alkaline substances from the surface of the zinc plating layer 41.

Figure 4:
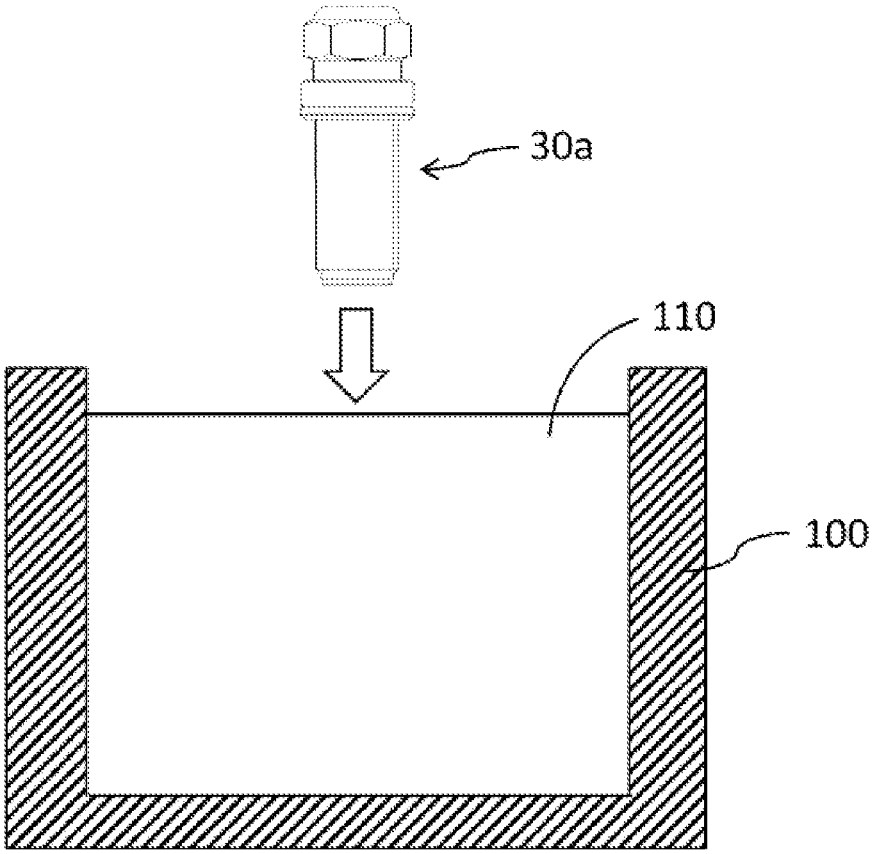
FIG. 4 is a schematic view showing a state in which a chemical conversion coating layer forming step shown in FIG. 3 is performed.

After completion of the nitric acid activation treatment step (S12), the chemical conversion coating layer forming step (S13) is performed. Specifically, as shown in FIG. 4, the metallic shell body 30*a* having undergone plating is immersed in a chemical tank 100 filled with a chromate treatment solution 110.

The chromate treatment solution 110 mainly contains a chromium supply agent, a zirconium supply agent, and an additive. The chromium supply agent contains chromium nitrate, a carboxylate salt, etc. The zirconium supply agent includes a zirconium salt such as zirconium chloride or zirconium nitrate. The additive includes a metal chloride, silicon dioxide ($SiO_2$), etc.

Also, the chromate treatment solution 110 may contain a cobalt supply agent. The cobalt supply agent includes a cobalt salt such as cobalt chloride or cobalt nitrate.

As described above, in order to suppress elution of hexavalent chromium from the chemical conversion coating layer 42, the cobalt component content of the chemical conversion coating layer 42 is preferably regulated to 0.1 mass % or less. Thus, in a preferred manner, the cobalt content of the chromate treatment solution 110 is a very low level (for example, 0.1 mass % or less) or contains no cobalt.

The pH of the chromate treatment solution 110 may be adjusted to fall within the range of, for example, 1 to 4. The pH may be adjusted by adding, for example, nitric acid, dilute nitric acid, or hydrochloric acid, and sodium hydrate. The temperature of the chromate treatment solution 110 may be adjusted to fall within the range of, for example, 20° C. to 40° C. The duration of time for immersing the metallic shell body 30*a* in the chromate treatment solution 110 (i.e., treatment time) may be adjusted to fall within the range of, for example, 30 sec to 60 sec.

By conducting the chemical conversion coating layer forming step (S13) under the above-described conditions, the chemical conversion coating layer 42 is formed on the surface of the metallic shell body 30*a* with the zinc plating layer 41 formed thereon. More specifically, the chromium layer 43 and the silicon layer 44 are successively formed on the zinc plating layer 41. The zirconium component content or the cobalt component content of the chemical conversion coating layer 42 may be tuned by appropriately modifying the aforementioned conditions (i.e., composition, pH, and temperature of the chromate treatment solution 110 and immersion time). In addition, the thickness t2 of the chromium layer 43 and the thickness t3 of the silicon layer 44 may be tuned by appropriately modifying the aforementioned conditions (i.e., composition, pH, and temperature of the chromate treatment solution 110 and immersion time).

After completion of the chemical conversion coating layer forming step (S13), the metallic shell body 30*a* is removed from the chromate treatment solution 110. Then, the drying step (S14) is conducted, to thereby dry the coating formed on the surface of the metallic shell body 30*a*. In the drying step (S14), the environmental temperature is preferably set to 40 to 220° C.

Through the aforementioned procedure, the coating is formed on the surface of the metallic shell body 30*a*. After that, the ground electrode 11, etc. are attached to the forward end side of the metallic shell body 30*a*. Thus, the metallic shell 30 is obtained. The metallic shell 30 is used as one of the parts of the spark plug 1 at the time of manufacture thereof. Since a conventionally known manufacturing method can be applied to manufacture of the spark plug 1 including the metallic shell 30, its detailed description is omitted.

(Summary of Embodiment)

As described above, the spark plug 1 according to the present embodiment includes the metallic shell 30, the insulator 50, the center electrode 20, and the ground electrode 11. The metallic shell 30 includes the tubular metallic shell body 30*a*, the zinc plating layer (metal plating layer) 41 provided on the surface of the metallic shell body 30*a*, and the chemical conversion coating layer 42 provided to cover the zinc plating layer 41.

The chemical conversion coating layer 42 is a so-called chromate coating, which contains chromium and other elements. The chemical conversion coating layer 42 further contains a zirconium component in an amount of 0.1 mass % or more.

According to the aforementioned configuration, the chemical conversion coating layer 42 is provided so as to cover the zinc plating layer 41, whereby corrosion of the zinc plating layer 41 can be suppressed. In addition, by incorporating, into the chemical conversion coating layer 42, a zirconium component in an amount of 0.1 mass % or more, transformation of the chromium component into hexavalent chromium in the chemical conversion coating layer 42 can be suppressed, whereby elution of hexavalent chromium from the metallic shell 30 can be suppressed. Through fabrication of the spark plug 1 by use of this metallic shell 30, the obtained spark plug 1 provides a reduced adverse effect on the environment.

Notably, the chemical conversion coating layer 42 may further contain a cobalt component. By virtue of the cobalt component, corrosion of the surface of the metallic shell can be suppressed. That is, the presence of the cobalt component and the zirconium component in the chemical conversion coating layer 42 achieves corrosion-inhibitory action attributable to the cobalt component and hexavalent chromium elution inhibitory action attributable to the zirconium component.

Furthermore, by reducing the amount of cobalt component in the chemical conversion coating layer 42 to as low a level as possible (e.g., a level equal to or lower than the amount of the zirconium component), the amount of elution of hexavalent chromium can be further reduced.

Working Example

The present invention will next be described by way of the following working example, which should not be construed as limiting the invention thereto.

(Formation of Coating on Metallic Shell Body)

In the present working example, a plurality of metal shell bodies 30*a* each having the structure described in the aforementioned embodiment were prepared, and a process of forming a coating on the surface was performed. Notably, no particular limitation is imposed on the material of the metallic shell body 30*a*, and a low carbon steel was used in the present working example.

First, each metallic shell body 30*a* was plated. Specifically, a zinc plating layer 41 having a thickness of about 0.5 to 1.0 μm was formed by performing a conventionally known electro-galvanizing process using an alkaline bath.

Subsequently, water-washing and nitric acid activation were performed through customary methods, and then the metallic shell body 30*a* was immersed in the chromate treatment solution 110 for chromate treatment (i.e., the chemical conversion coating layer forming step of the present embodiment). As a result, a chemical conversion coating layer 42 including the chromium layer 43 and the silicon layer 44 was formed on the surface of the zinc plating layer 41.

The chromate treatment solution 110 used contained the following agents, solvent, etc. Notably, the proportions of the respective agents were modified among samples (Examples A to F and Comparative Examples G and H)

Chromium (Cr) supply agent content (as Cr content) of treatment solution: 500 to 4,000 ppm Zirconium (Zr) supply agent content (as Zr content) of treatment solution: 0.9 to 6.5 ppm Additive content of treatment solution: 10 to 70 mL/L Cobalt (Co) supply agent content (as Co content) of treatment solution: 0 to 50 ppm In all samples (Examples A to F and Comparative Examples G and H), the pH of the chromate treatment solution 110 was adjusted to 3.0 by use of dilute nitric acid. Also, in all samples (Examples A to F and Comparative Examples G and H), the temperature of the chromate treatment solution 110 was adjusted to 30° C. The treatment time (immersion time) was 45 seconds with respect to all samples (Examples A to F and Comparative Examples G and H).

Table 1 shows proportions of the agents contained in each chromate treatment solution applied to the samples (Examples A to F and Comparative Examples G and H).

TABLE 1

| | | Ex. A | Ex. B | Ex. C | Ex. D | Ex. E | Ex. F | Comp. Ex. G | Comp. Ex. H |
|---|---|---|---|---|---|---|---|---|---|
| Agent proportions | Cr supply agent | 3 | 3 | 3 | 3 | 3 | 3 | 3 | 3 |
| | Zr supply agent | 1 | 2 | 2 | 3 | 4 | 5 | — | — |

TABLE 1-continued

| | Ex. A | Ex. B | Ex. C | Ex. D | Ex. E | Ex. F | Comp. Ex. G | Comp. Ex. H |
|---|---|---|---|---|---|---|---|---|
| Additive | 3 | 3 | 3 | 4 | 3 | 3 | 3 | 3 |
| Co supply agent | 3 | 3 | — | — | — | — | 4 | 3 |

In Table 1, the Cr supply agent content, the Zr supply agent content, the additive content, and the Co supply agent content of the chromate treatment solution 110 employed in each of the Examples and Comparative Examples is represented by a numerical value "1" to "5." In each case, the value represents a concentration parameter obtained by dividing the corresponding concentration range by five. Specifically, as to the Cr supply agent, a numerical value "3" represents about 2,250 ppm. As to the Zr supply agent, a numerical value "1" represents about 0.9 ppm; a numerical value "2" represents about 2.3 ppm; a numerical value "3" represents about 3.7 ppm; a numerical value "4" represents about 5.1 ppm; and a numerical value "5" represents about 6.5 ppm. As to the additives, a numerical value "4" represents about 40 mL.

As to the Co supply agent, a numerical value "3" represents about 25 ppm, and a numerical value "4" represents about 38 ppm.

In Examples C, D, E, and F, no Co supply agent was added to the treatment solution. In Comparative Examples G and H, no Zr supply agent was added to the treatment solution.

(Measurement of Component Content)

Through the aforementioned procedure, a coating was formed on each of the samples of metallic shell body 30*a* (Examples A to F and Comparative Examples G and H). The zirconium component content (mass %) and the cobalt component content (mass %) of the chemical conversion coating layer 42 provided on each sample were determined. In a specific determination procedure, a cut surface of the coating provided on each sample was developed by means of a focused ion beam (FIB) system, and the cut surface was observed under a scanning transmission electron microscope (STEM).

The following Table 2 shows the determined values of the zirconium component content (mass %) and the cobalt component content (mass %) of each sample.

TABLE 2

| | | Ex. A | Ex. B | Ex. C | Ex. D | Ex. E | Ex. F | Comp. Ex. G | Comp. Ex. H |
|---|---|---|---|---|---|---|---|---|---|
| Content [wt. %] | Co | 0.1 | 0.1 | <0.1 | <0.1 | <0.1 | <0.1 | 0.2 | 0.1 |
| | Zr | 0.1 | 0.2 | 0.2 | 0.4 | 0.8 | 2.0 | 0 | 0 |
| Hexavalent Cr elution ($\mu g/cm^2$) | | 0.016 | 0.008 | 0.006 | 0.004 | 0.002 | 0.002 | 0.068 | 0.032 |

As shown in Table 2, in the samples treated with a chromate treatment solution containing no Zr supply agent (Comparative Examples G and H), no zirconium component was detected in the chemical conversion coating layer 42. In contrast, in the samples treated with a chromate treatment solution containing the Zr supply agent (Examples A to F), the zirconium component content of the chemical conversion coating layer 42 was found to increase in response to the amount of zirconium component present in the treatment solution.

In the samples treated with a chromate treatment solution containing no Co supply agent (Examples C, D, E, and F), the cobalt component content of the chemical conversion coating layer 42 was found to be lower than the detection limit (i.e., <0.1 mass %).

(Chromium Elution Test)

Samples (Examples A to F and Comparative Examples G and H) were tested in terms of amount of elution of hexavalent chromium. In a specific procedure, each sample was allowed to stand for 6 days in an atmosphere (40° C. and humidity of 98%), and then a hexavalent chromium elution test based on the European standard EN15205 was performed.

Figure 5:
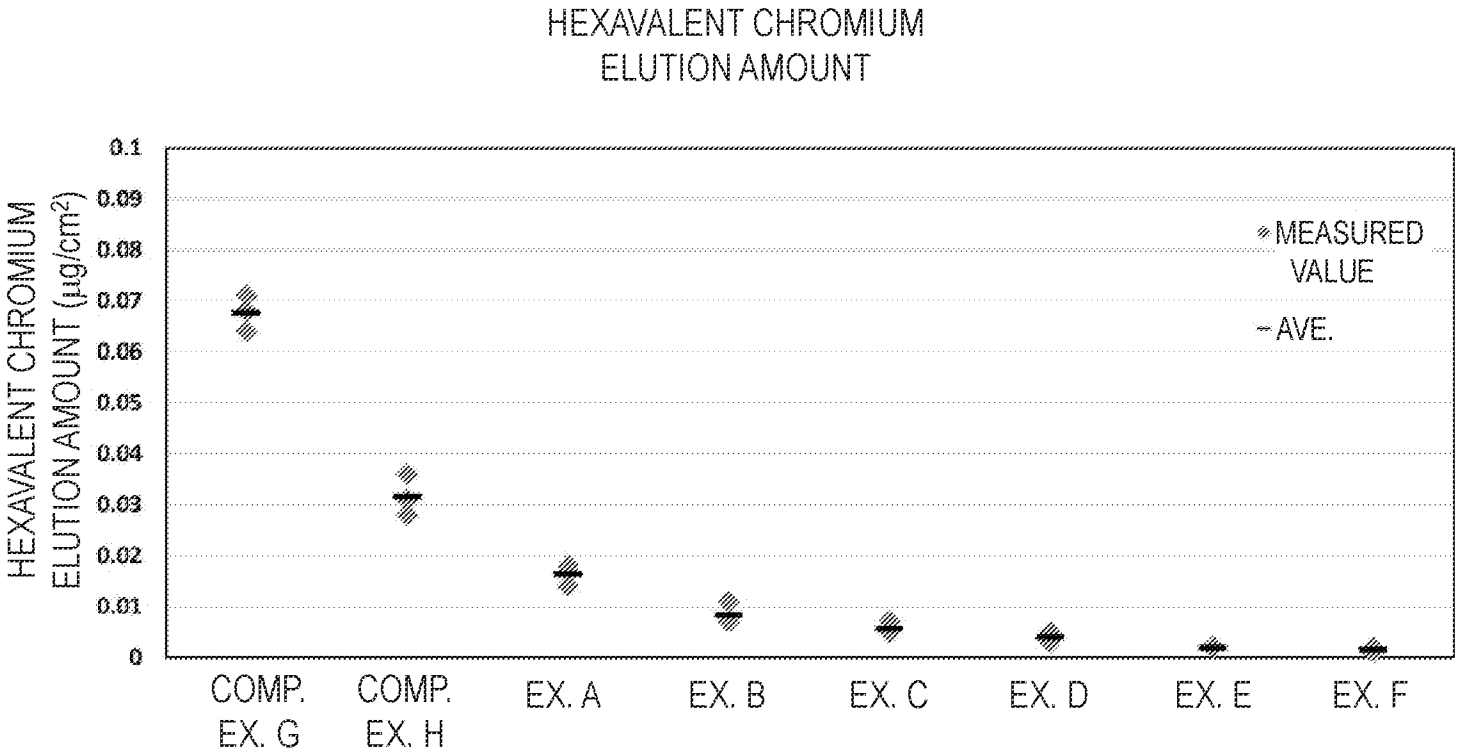
FIG. 5 is a graph showing the results of a chromium elution test performed in the present Example.

Table 2 and FIG. 5 show the results. FIG. 5 shows the actually measured elution amounts ($\mu g/cm^2$) of a plurality of samples (Examples A to F and Comparative Examples G and H) and the average of the corresponding measured values. Table 2 shows the average (Ave.) of the hexavalent chromium elution amounts ($\mu g/cm^2$) of each sample.

As shown in FIG. 5, the hexavalent chromium elution level of the samples having a zirconium component content of the chemical conversion coating layer 42 of 0.1 mass % or more (Examples A to F) was found to be successfully lowered, as compared with the samples having a chemical conversion coating layer 42 containing no zirconium component (Comparative Examples G and H).

Also, the hexavalent chromium elution level of the samples having a chemical conversion coating layer 42 in which the cobalt component content was lower than the zirconium component content (Examples B to F) was found to be further lowered, as compared with the sample having a chemical conversion coating layer 42 in which the cobalt component content was almost equivalent to the zirconium component content (Example A).

In addition, the hexavalent chromium elution amount was found to be further lowered, as the zirconium component content of the chemical conversion coating layer 42 increased. Notably, the hexavalent chromium elution level of the samples having a zirconium component content of the chemical conversion coating layer 42 of 0.8 mass % or more (Examples E and F) was found to be 0.002 $\mu g/cm^2$ (i.e., the detection limit) or less.

Based on the test results as described above, elution of hexavalent chromium from the metallic shell was successfully suppressed, when the chemical conversion coating layer 42 has a zirconium component of 0.1 mass % or more.

The embodiments disclosed this time must be considered to be illustrative and not restrictive in all aspects. It is intended that the scope of the present invention is shown by the claims rather than the above description, and the present invention encompasses all modifications within the meanings and scopes equivalent to those of the claims. Also, the present invention encompasses configurations obtained by combining the configurations of different embodiments described in the present specification.

REFERENCE SIGNS LIST

1: spark plug
11: ground electrode
20: center electrode
30: metallic shell (metallic shell for spark plug)
30*a*: metallic shell body
41: zinc plating layer (metal plating layer)
42: chemical conversion coating layer
43: chromium layer
44: silicon layer
50: insulator

What is claimed is:

1. A metallic shell for a spark plug, the metallic shell comprising:

a tubular metallic shell body;

a metal plating layer provided on a surface of the metallic shell body; and a chromium-containing chemical conversion coating layer provided to cover the metal plating layer, wherein the chemical conversion coating layer has a zirconium component content of 0.1 mass % or more.

2. The metallic shell for a spark plug according to claim 1, wherein the chemical conversion coating layer has a zirconium component content of 2.0 mass % or less.

3. The metallic shell for a spark plug according to claim 1, wherein the chemical conversion coating layer further comprises a cobalt component, and the cobalt component content is equal to or lower than the zirconium component content.

4. The metallic shell for a spark plug according claim 1, wherein the chemical conversion coating layer further comprises a cobalt component and has a cobalt component content of 0.1 mass % or less.

5. A spark plug comprising:

a metallic shell for a spark plug, wherein the metallic shell includes a tubular metallic shell body, a metal plating layer provided on a surface of the metallic shell body, and a chromium-containing chemical conversion coating layer provided to cover the metal plating layer, said chemical conversion coating layer having a zirconium component content of 0.1 mass % or more;

a tubular insulator at least partially disposed in the metallic shell;

a center electrode disposed at a forward end of the insulator; and a ground electrode joined to the metallic shell and forming a gap between the ground electrode and the center electrode.

6. The spark plug according to claim 5, wherein the chemical conversion coating layer has a zirconium component content of 2.0 mass % or less.

7. The spark plug according to claim 5, wherein the chemical conversion coating layer further comprises a cobalt component, and the cobalt component content is equal to or lower than the zirconium component content.

8. The spark plug according claim 5, wherein the chemical conversion coating layer further comprises a cobalt component and has a cobalt component content of 0.1 mass % or less.

* * * * *